US006092549A

United States Patent [19]

Eriksson

[11] Patent Number: 6,092,549

[45] Date of Patent: Jul. 25, 2000

[54] DEVICE IN A WASTE DISPOSAL SYSTEM IN A BUILDING

[76] Inventor: Bertil Eriksson, Markvägen 1 D, Själevad, SE-890 23, Sweden

[21] Appl. No.: 09/066,428

[22] PCT Filed: Oct. 29, 1996

[86] PCT No.: PCT/SE96/01383

§ 371 Date: Apr. 30, 1998

§ 102(e) Date: Apr. 30, 1998

[87] PCT Pub. No.: WO97/16608

PCT Pub. Date: May 9, 1997

[30] Foreign Application Priority Data

Nov. 1, 1995 [SE] Sweden ..... 9503851

[51] Int. Cl.[7] ..... E03D 9/04

[52] U.S. Cl. ..... 137/357; 4/211; 4/219; 137/340

[58] Field of Search ..... 134/357, 340; 4/211, 219

[56] References Cited

U.S. PATENT DOCUMENTS

| | | | |
|---|---|---|---|
| 606,417 | 6/1898 | Hyde . | |
| 675,342 | 5/1901 | Sayers | 4/219 |
| 992,882 | 5/1911 | Kletzsch | 4/211 |
| 1,560,679 | 11/1925 | Elliott | 137/357 |
| 1,661,532 | 3/1928 | Fortain | 4/211 |
| 3,651,524 | 3/1972 | Bengtsson et al. . | |
| 4,129,906 | 12/1978 | Ohringer . | |
| 4,359,789 | 11/1982 | Roberts . | |

FOREIGN PATENT DOCUMENTS

| | | |
|---|---|---|
| 2681354 | 3/1993 | France . |
| 2726527 | 12/1978 | Germany . |
| 3500130 | 7/1986 | Germany . |
| 382651 | 4/1975 | Sweden . |
| 389881 | 10/1976 | Sweden . |
| 409480 | 6/1979 | Sweden . |
| 443176 | 9/1982 | Sweden . |

*Primary Examiner*—A. Michael Chambers
*Attorney, Agent, or Firm*—Dilworth & Barrese

[57] ABSTRACT

The drain system in a building is divided in at least two parts, namely a first part (2) arranged to receive drain water contaminated to a relatively high degree from one or a plurality of first units (3), and a second part (10) arranged to receive drain water normally contaminated to a lower degree from one or a plurality of second units (11, 12). The second drain system part (10) comprises at least one drain conduit (13) and at least one unit (11) connected thereto and so constructed that it lacks traps preventing a flow of air therethrough. An apparatus (16) is connected to the drain conduit (13), for generating such a negative pressure in the drain conduit giving rise to an evacuating flow of air from the room in question in the building through the at least one unit (11) and through the drain conduit (13).

24 Claims, 3 Drawing Sheets

DEVICE IN A WASTE DISPOSAL SYSTEM IN A BUILDING

BACKGROUND OF THE INVENTION

The present invention relates to a an arrangement in a drain system in a building. The arrangement is thereby primarily intended to be constructed in accordance with an arrangement in a drain system in a building, wherein the drain system is divided into at least two parts, namely a first part arranged to receive drain water contaminated to a relatively high degree from one or a plurality of first units, and a second part arranged to receive drain water normally contaminated to a lower degree from one or a plurality of second units.

Such a dividing of the drain system in at least two parts is advantageous because drain water contaminated to different degrees may be object for different following treatments or uses.

Prior art according to the preamble of claim 1 is for example represented in SE 389 881, DE 2 726 527, DE 3 500 130 and FR 2 681 354.

According to a first aspect of the invention, it is based on the knowledge that it is desirable to improve the conditions in buildings, for example in such wet rooms, as for example shower rooms and bath rooms, but also kitchens, washing rooms, toilet rooms etc. The more or less damp environment in such rooms may namely cause serious disadvantages for people as well as to the building. The damp environment implies more exactly good conditions for growth of bacteria, mole and fungus. Besides some noxious insects thrive in the wet environment and may there reproduce very fast. The wet environment also means a risk for moisture to penetrate in the building construction and give rise to rot or other damages. According to another aspect of the invention it will be described starting from an arrangement in a drain system in a building, comprising at least one drain conduit arranged to receive drain water from at least one unit connected thereto, the unit being constructed so that it lacks traps preventing a flow of air therethrough, with an apparatus being connected to the drain conduit for generating a negative pressure in the drain conduit such that an evacuating flow of air is created from the room in question in the building through the unit and through the drain conduit. Such a construction is in itself previously described in U.S. Pat. No. 606,417. Drain conduits are there described to be connected to all existing units producing drain water to the drain system in a building. These drain conduits are then by means of conduit portions generating a natural draught connected to the surroundings, the intention being to avoid that unpleasant fumes from the drain system reaches into the building by means of air evacuation by the units, drain conduits and the conduit portions. Besides a certain degree of ventilation effect will arise. The solution described in U.S. Pat. No. 606,417 has severe disadvantages. According to the first aspect of the invention, the US patent is based on that drain waters contaminated to relatively varying degrees are collected to one single exhaust air main conduit. This is a substantial disadvantage since it will be very difficult to take care of and/or recycle components in the drain water or the water itself in an environmental advantageous way.

Besides, the solution according to the U.S. Pat. No. 606,417 leads to serious problems of risking dangerous or at least very unpleasant fumes penetrating into the building by disturbances in the natural draught system and/or by the units itself or the connected drain conduits thereto being plugged up. Within the scope of the second aspect of the invention it would be valuable if the latter disadvantage in U.S. Pat. No. 606,417 could be avoided.

Further examples of prior art within the field of drain systems are described in SE 443 176 and U.S. Pat. No. 3,651,524. The solutions according to these patents are however based on the idea to facilitate the drain water transport from units delivering drain water to the drain system through branch conduits located in said systems by means of a negative pressure in said drain system, said branch conduits connecting the units with a stem conduit comprised in the system, specific valves being arranged to normally prevent a flow of air therethrough from said units to said stem conduit on other occasions than when the user opens these valves momentarily for transport of a certain drain volume from said unit to said stem conduit and further to an outgoing main conduit. SE 443 176 and U.S. Pat. No. 3,651,524 are finally describing how drain water are collected from diametric different units and contaminated to very varying degrees, with the disadvantages already discussed.

SUMMARY OF THE INVENTION

The object of the present invention is according to the first aspect to further develop the arrangement described above to achieve an environmentally better working arrangement according to both taking care of the drain water and the environment in the building.

This object is achieved according to the invention by way of providing the arrangement with the characteristics that further will be described below, namely at least one of the drain system parts comprising at least one drain conduit and at least one unit connected thereto and constructed so that the unit lacks trap preventing a flow of air therethrough, and an apparatus being connected to the drain conduit for generating a negative pressure in the drain conduit such that an evacuating flow of air is created from the room in question in the building through the at least one unit and through the drain conduit.

The dividing of the drain system in at least two parts provides in a per se way excellent possibilities to efficiently in different ways take care of/treat the drain water contaminated to different degrees. The utilizing of at least one unit for a ventilating evacuation of air from the room in question in the building means that the drain system itself may be utilized as a ventilation device.

The second aspect of the present invention is aiming at good security for an absence of negative pressure intended to be generated by said apparatus will not give rise to an inflow of unpleasant fumes from the drain system into the building at an arrangement according to the invention described herein (U.S. Pat. No. 606, 417).

This object will according to the invention be achieved by way of that the apparatus generating the negative pressure consists of a fan and besides actions are taken for achieving natural draught in the drain conduit in question, a non-return valve being arranged at the fan to reverse the function at an operation breakdown so that the natural draught takes over the function of providing the evacuating flow of air.

In spite of utilizing the draught system for ventilation a high security against penetration of unacceptable fumes in the building will be secured in the case where said at least unit serving for ventilation purposes belongs to the second drain system part, i.e. the part that takes care of drain water normally contaminated to a low degree. The first units in the first drain system part are not intended to be utilized for ventilation purposes but instead having traps, preferably water seals, of its own preventing the flow of air therethrough. The existing risk of unacceptable penetration of unpleasant fumes into the building from said first drain system part in for example the U.S. Pat. No. 606,417 is thereby avoided.

It should however be noted that the present invention is intended to comprise that in principle all sorts of units delivering drain water located in a building i.e. not only floor drains, water basins, sink drains and similar but also water closets and similar will be utilized for evacuation of air out of the building by lacking traps preventing a flow of air therethrough and by being connected to drain conduits comprised in said drain system, wherein a negative pressure will be generated giving rise to an evacuating flow of air from the building through the units in question and further through the drain conduits.

In the case where several different drain conduits, for example vertical drain stem conduits, intended to receive different types of drain water contaminated to different degrees may all these drain conduits have one or several units delivering drain water, said units lacking traps preventing a flow of air therethrough in a way that all these drain conduits may function for ventilation purposes. The invention comprises however, also all such embodiments where the characteristic based on the evacuation of air according to the invention will be utilized in a lesser degree; thus, the invention comprises all such embodiments, where a number of drain conduits within the range from one up to all, for example stem conduits, said drain conduits having air evacuating units delivering drain water in the drain system and are connected to one or several apparatuses generating negative pressure in order to achieve the evacuating flow of air in one or several of said drain conduits.

Advantageous embodiments of the already discussed ideas of the invention will be taken care of in the dependent claims.

BRIEF DESCRIPTION OF THE DRAWINGS

With reference to the appended drawings, below follows a description of preferred embodiments of the invention cited as examples. In the drawings.

DETAILED DESCRIPTION OF A PREFERRED EMBODIMENT

Figure 1:
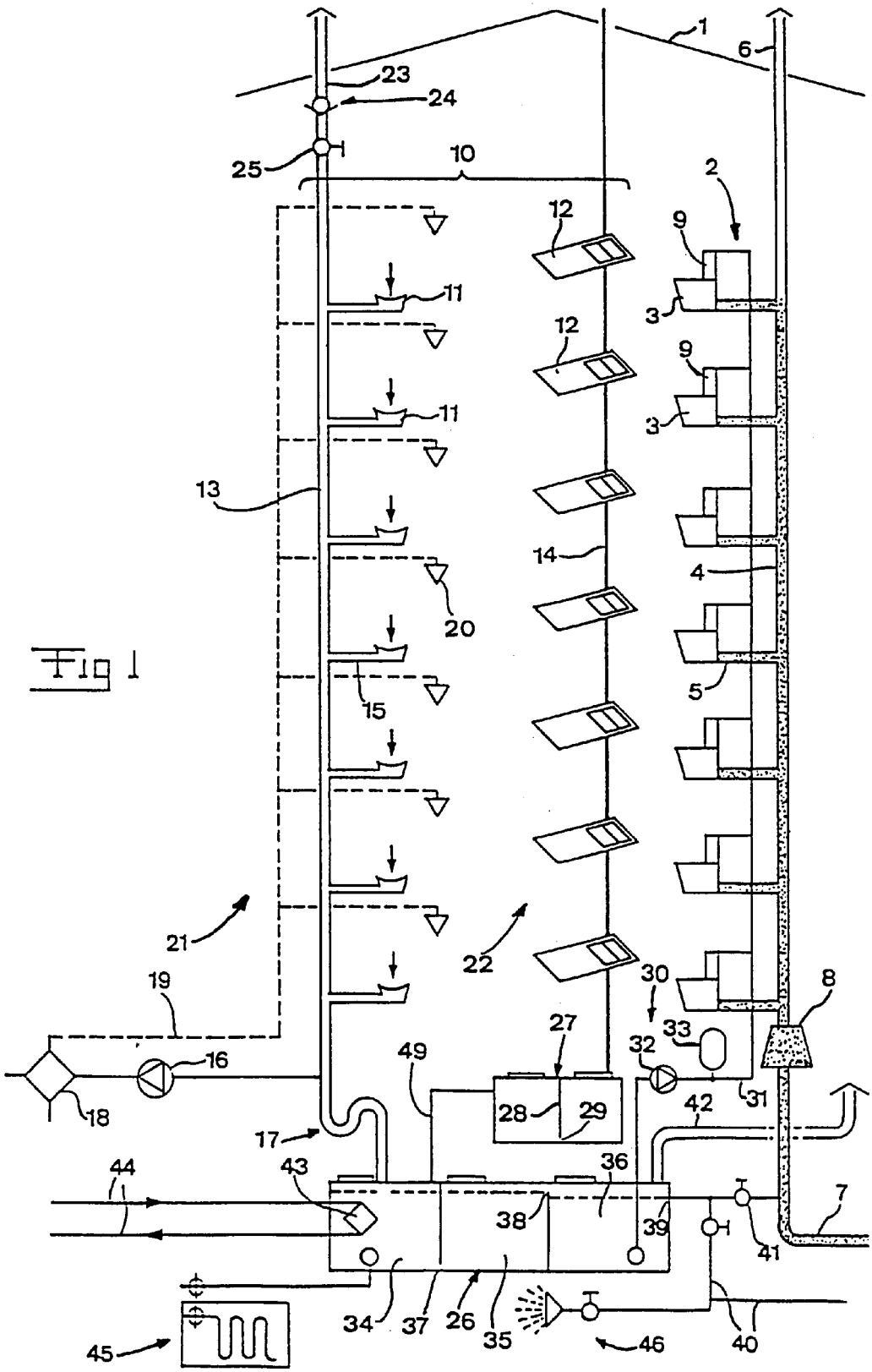
FIG. 1 is a very schematical representation of a building provided with a drain system and thereto connected units, by which drain water is delivered to the drain system.

The building in the drawing illustrated with a schematical roof 1 has a drain system. This drain system is divided into at least two parts, namely a first part 2 arranged to receive drain water contaminated to a relatively high degree from one or a plurality of first units 3. In the example it is indicated how the units 3 may consist of water closet apparatuses, which here are indicated as water closets, intended for receiving urin and fekals from persons in the building. In the example it is illustrated how the building may comprise a plurality of floors with water closet apparatuses on each floor. It should be noted that the present invention is applicable independent of if the number of floors in the building is one or several.

Said drain system part 2 comprises a stem drain conduit 4 connected to the units 3 by branch conduits 5. Said stem conduit 4 is provided with a conduit portion 6 emerging above the roof 1 for ventilation purposes in a conventional way within the field of the drain technique, i.e. an inflow of air takes place when the drain water is moving downwards in said stem conduit 4.

The incoming drain water in said stem conduit 4 comprises considerable amounts of organical material. This material may be utilized by increased concentration, for example as fertilising substance or earth improvement substance after suitable treatment and possible supply of additives. The resulting water from this concentration is subject to such cleaning that it may be used for suitable purposes or alternatively be brought back into nature, for example in water courses. In the figure there is illustrated with 7 how the stem conduit 4 may communicate with a drain main conduit for discharging the drain water for further treatment. Said stem conduit 4 may be coordinated with a flow amplifier 8 of a per se known type if it is required to contribute to the flow of the drain water in said drain system part 2.

In the drawing flushing apparatuses for the water closet units 3 are indicated with 9. Thus, a certain amount of flushing water is intended to be utilized for transporting particularly the feces to the stem conduit 4 and further on. It should in this context be noted that the idea of the invention also is applyable on a drain system part 2 constructed so that the water closet units 3 having openable valves while a vacuum pump is connected to the stem conduit 4, said pump being arranged to establish a vacuum facilitating the transport of the fekals from the units 3 through the branch conduits 5 and at least partly in the stem conduit 4. Thus, the opening of the valves at the water closet units 3 will by way of the originated flow of air support the fekal transport. Normally these valves are closed, so that no flow of air through the units 3 takes place.

Another modification within the scope of the invention is to divide the drain system part 2 into two separate sections, namely one for urine and one for feces. This possibly requires a doubling of the units 3 in order for units intended for receiving urine are connected to the first section while units intended for receiving feces are connected to the other section. The flushing apparatuses should thereby be able to be limited to the units intended for receiving feces. Further it will be possible to form water closet units 3 capable of receiving urine and feces in separate receiving portions, possibly after a certain reconnection, in a way that the urine could be led to the first section while feces could be led to the other section.

Thus, it would be possible to obtain urine in a first stem conduit included in the first section while feces could be obtained in a second stem conduit belonging to the other section. These different fluxes could thereafter be subjected to different use/treatment.

In addition to the drain system part indicated with 2, said drain system is also including a part generally indicated with 10 arranged to receive drain water normally contaminated to a low degree from one or a plurality of second units 11, 12.

Said second drain system part 10 comprises at least one stem-like drain conduit 13, 14 to which the units 11, 12 are connected, possibly by branch conduits 15.

At least one 11 of the units 11, 12 is so constructed that it lacks traps preventing a flow of air therethrough. The unit 11 in question is instead open so that air may flow into the unit and further to the stem conduit 13. An apparatus 16 for generating a negative pressure in the conduit 13, is connected to the stem conduit 13 causing an evacuating, ventilating flow of air from the room in the building, where the unit 11 in question is located, through the unit 11 and through the conduit 13.

The first units 3 in the drain system part 2 are supposed to have traps preventing a flow of air therethrough, especially water seals, in the examplified case in the drawing. These traps are effectively blocking an inflow of air through the units 3 in the stem conduit 4 as well as an exhaust air of fumes from the stem conduit 4 into the building.

The drain conduit 13 has a trap 17, preferably a water seal, preventing a flow of air therethrough. The apparatus 16 generating the negative pressure is connected to the conduit 13 upstream of the trap 17, according to the drain water.

At operation of the apparatus 16, formed by a suitable fan, a negative pressure will be obtained in the conduit 13 and this negative pressure will communicate with the units 11 generating a flow of air into these units and the conduit 13. The units 11 will thereby function as an exhaust air device inside the building. The fan 16 is arranged to discharge the exhaust air to the surroundings. This may occur after that the relatively warm exhaust air has been brought to transfer its heat contents to another medium in a heat exchanger 18. This other medium could consist of supply air to the building according to an embodiment of the invention. A conduit for supply air is indicated with 19 in the drawing, said conduit delivering supply air to desired locations in the building by suitable drawing, which is indicated at 20. The supply air device 20 would thereby for example deliver air to the rooms, flats or premises, from which the units 11 discharge exhaust air.

The second drain system part 10 may be divided into two sections 21, 22, respectively. The section 21 thereby having the previously described units 11, lacking traps preventing a flow of air therethrough and the stem conduit 13 as well as the branch conduits 15. The section 22 has a stem conduit 14, to which other drain water delivering units 12 of a different kind than the units indicated with 11, are connected. The units 12 could for example consist of sinks. In such sinks a great deal emanating drain from kitchen garbage ends up. This means that the contents of organical material, for example in the form of dishes, fat etc, in the stem conduit 14 certainly is substantially less than in the stem conduit 4, but it may be more than the part of organical substances and possible other contaminations ending up in the stem conduit 13. This is due to the units 11 connected to the stem conduit 13 being arranged to receive drain water contaminated to a lower degree, for example drain water from showers, bath tubs or similar. Thereby the units 11 preferably consist of floor drains or similar as indicated in the drawing. Normally showers, bath tubs etc are namely connected in a way that drain water therefrom ends up in floor drains.

Conventional lavatories prevailing in flats and in premises could be connected to any of the stem conduits 13 and 14 depending on an estimation of the degree of contamination. It is namely desirable to supply the lavatory drain water to the stem conduit 14, if it is estimated to be considerably more contaminated than the drain water in the stem conduit 13 and to the latter in the inverse case.

The sink units 12 connected to the stem conduit 14 are in a conventional way intended to have traps, preferably water seals, preventing a flow of air therethrough, in the example illustrated in the drawing, so that no unhealthy or unpleasant fumes from the inside of the conduit 14 may reach into the building. It would however also be possible to arrange the units 12 without traps preventing a flow of air therethrough and to connect that stem conduit 14 to an arrangement generating a negative pressure similar to the arrangement indicated with 16 so that consequently also the units 12 would get the character of an exhaust air device similar to what has been described above for the units 11.

According to another alternative not shown in the drawing, but within the scope of the invention, the units 12 are also connected to the same stem as the units 11 as far as it is not undesirable to separate the drain water from the units 11 and 12. The units 12 would thereby optionally have or lack traps preventing a flow of air therethrough.

The previously mentioned lavatories would also optionally be able to have or lack traps preventing flow of air therethrough depending if they must to function as exhaust air devices or not.

The drain system part section 21 is connected to the surroundings above the roof 1 by a conduit portion 23 to achieve natural draught, i.e. a suction effect to the surroundings. In the conduit portion 23 a non-return valve 24 is located to block an inflow of air through the conduit portion, said non-return valve being intended to open by means of the rising natural draught at an operational breakdown of the fan 16. This implies accordingly that a negative pressure is ensured in the conduit 13 independent of the fan 16 functioning or not. This ensures in turn that unintentional unpleasant fumes not may penetrate into the building through the units 11.

The non-return valve 24 is indicated schematically in the drawing. In practice it may consist of a relatively sensitive, flap-like valve, which effectively is closed as long as the fan 16 is operating, but which immediately opens affected by the natural draught as soon as the natural fan 16 stops.

If desired, yet another valve 25 may be located in the conduit portion 23, this valve may however not be a non-return valve. The valve 25 can to close to ensure that unintentional air from the surroundings will not flow into the conduit 13, for example at service or exchange of the valve 24. The valve 25 may thereafter once again be opened.

As an apparatus generating a negative pressure, for example a fan, is also connected to the stem conduit 14 with corresponding components 23, 24 and 25 arranged on the stem conduit 14.

A tank 26 is arranged for receiving the drain water normally contaminated to a relatively small degree. The arrangement may thereby allow the drain water from the stem conduit 13 to flow directly into the tank 26 through the trap 17. The drain water from the stem conduit 14 could on the other hand be conducted to a further tank 27, which may be arranged to function in and for separation of components from this drain water. The tank 27 may for example be formed to clean the drain water from solid contaminations and/or from fat. According to the separation of fat the tank 27 could thereby be provided with an intermediate wall 28, having an opener 29 at its lower parts for a flow of air therethrough, in such a way that the water which is heavier than fat may flow out of the room on one side of the intermediate wall to the room on the other side while the fat floating on the surface will remain in the first room. From this second room the somewhat cleaned drain water could thereafter be transmitted to the tank 26 by a conduit 49.

The arrangement according to the invention has means 30 for guiding the drain water provided from the second drain system part 10 to the water closet unit 3 to be used there as flushing water in the previously mentioned flushing devices 9. In this way the less contaminated drain water will thereby be utilized in an economically and non-polluting way as flushing water, which thereafter flows into the stem conduit 4.

In the example it is illustrated how said means 30 comprises a conduit extending from the tank 26 to the flushing devices 9 of the different units 3, which conduit generally is indicated with 31. A pump 32 is suitably arranged in the conduit. This pump may be arranged to function for building such pressure conditions in a pressure vessel 33 that the drain water may be directed up to the different flushing apparatuses 9 under influence of the pressure in the pressure vessel 33. The pump 33 is thereby suitably intermittent operated while being controlled by a pressure sensor.

The tank 26 may be arranged in a way that it quite simply works as a drain water accumulator. It may however also have the purpose of a cleaning operation, for example as a fat remover and/or a sedimentary tank. In the example it is indicated how the tank 26 comprises three different rooms 34, 35 and 36. The drain water enters in the room indicated with 34. The water may from this room flow over in the room 35 by an opening 37 located at a lower part so that accordingly fat components which are lighter than water will remain in the room 34. The drain water from the room 34 is intended to flow into the room 36 by a width gutter indicated at 38, which implies that heavier components than water tend to gather at the bottom of the room 35. Drain water would finally be taken from the room 36 for flushing by the conduit 31. Drain water would also be drained from the room 36 (for example through a width gutter indicated at 39), said drain water being conducted through conduit portions 40 for utilizing or treatment, for example cleaning. Drain water may be conducted through a normally closed valve 41 to the drain conduit 4, 7, if it is required, for example for flushing purposes or similar. The tank 26 has an air connection 42 emerging outside the building.

The drain water in the tank 26 may be utilized for different purposes. For example it would be possible to utilize the relatively hot water in the tank 26 to exchange heat from the drain water to another medium flowing in a path indicated at 44, by means of a heat exchanger 43. This medium would for example consist of fresh water intended to further heating in a boiler or similar, said fresh water entering into the building.

The way the drain water from the tank 26 may be utilized for fire control by means of suitable means including for example a hose apparatus and a high pressure pump is indicated schematically at 45. The way the drain water from the tank 26 may be utilized for all sorts of spray treatments, for example watering of plants, but also for various washing operations is finally indicated with 46.

It is noted that it is not substantial for the idea of the invention that the drain water from the conduits 13 and 14 is collected in the tank 26. It would thus be possible to keep drain water from the conduits 13 and 14 and thereby the different units 11, 12 respectively, completely separated whereby for example the drain water from the conduit 14 could be utilized for flushing purposes in the water closet units 3 and possibly for other purposes while the drain water from the conduit 13, which normally is somewhat cleaner than the drain water from the conduit 14 could be utilized for more "noble" tasks.

The described arrangement is by no means limited to the illustrated and the above discussed embodiment. Several modifications are thus possible without leaving the scope of the invention. According to one alternative embodiment the first units 3 in the drain system part 2 would also be possible to be formed in a way that they lack own traps preventing a flow of air therethrough. It is thus possible to form the first units 3 enabling an evacuating flow of air therethrough, which possibly should arise by generating a negative pressure in the drain conduit 4 connected to the units 3 by means of an apparatus similar to the one indicated with 16 or alternatively a single apparatus 16, which also generates a negative pressure in the conduit 13 and/or 14.

In the case where also the drain conduit 4 is intended to be connected to an apparatus generating a negative pressure for ventilation purposes, this apparatus should also be connected to the conduit 4, upstreams, according to the drain water, of a trap preventing a flow of air therethrough corresponding to the trap indicated with 17 for the drain conduit 13. From the discussion above it is clear that the flows of exhaust air of course will not have to be conducted in the same direction as the drain water in the drain conduits, but instead could be conducted upwardly.

Figure 2:
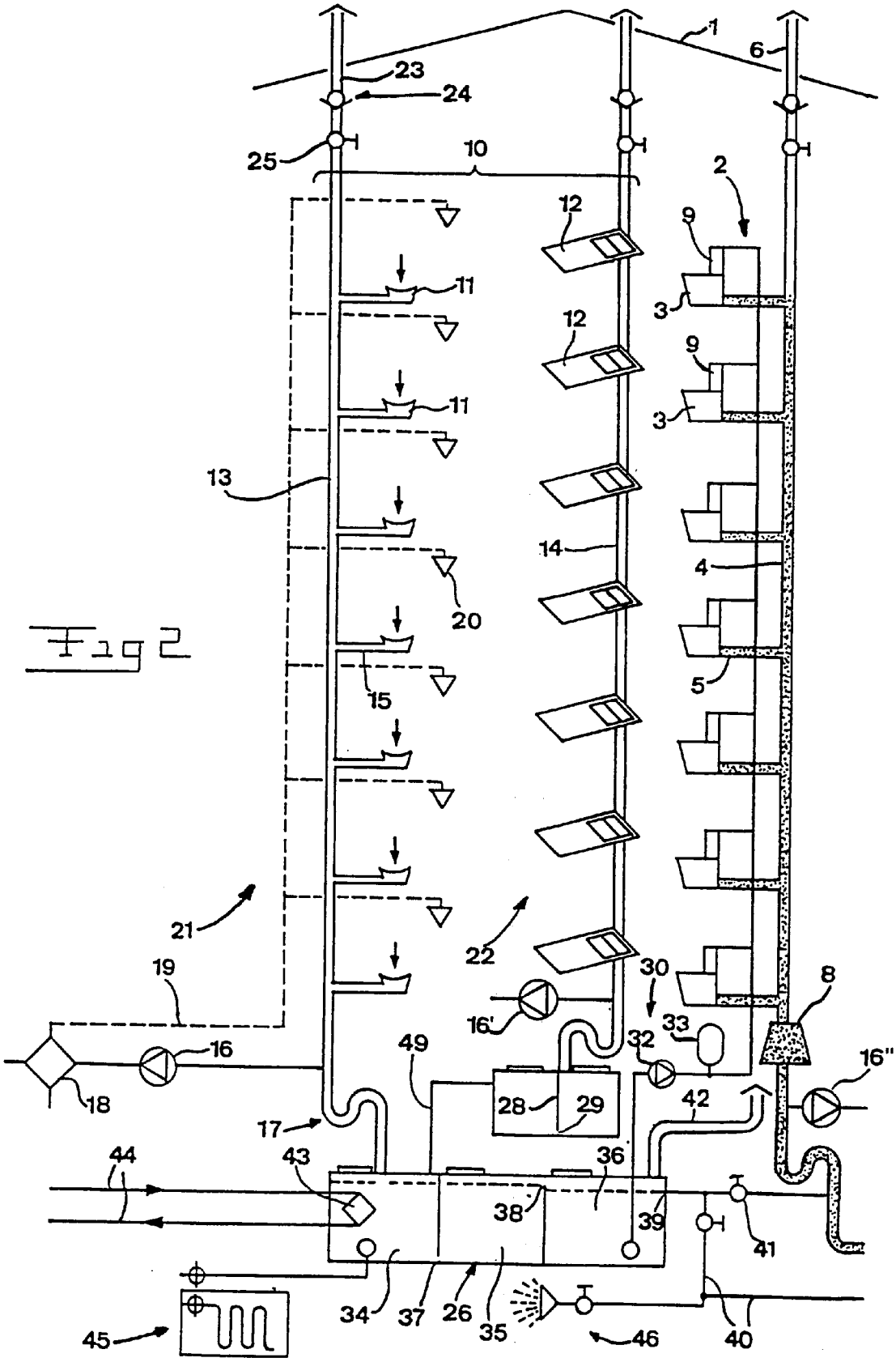
FIG. 2 is a view of a drain system according to FIG. 1, said system being somewhat modified with respect to the system of FIG. 1.

FIG. 2 illustrates how a drain system according to the invention is modified in the way described above. This drain system is distinguished from the one illustrated in FIG. 1 so that in this case the conduits 14 and 4 are also connected to the suction side of fans 16', 16" to also utilize the units 12, 3 respectively as exhaust air devices.

Figure 3:
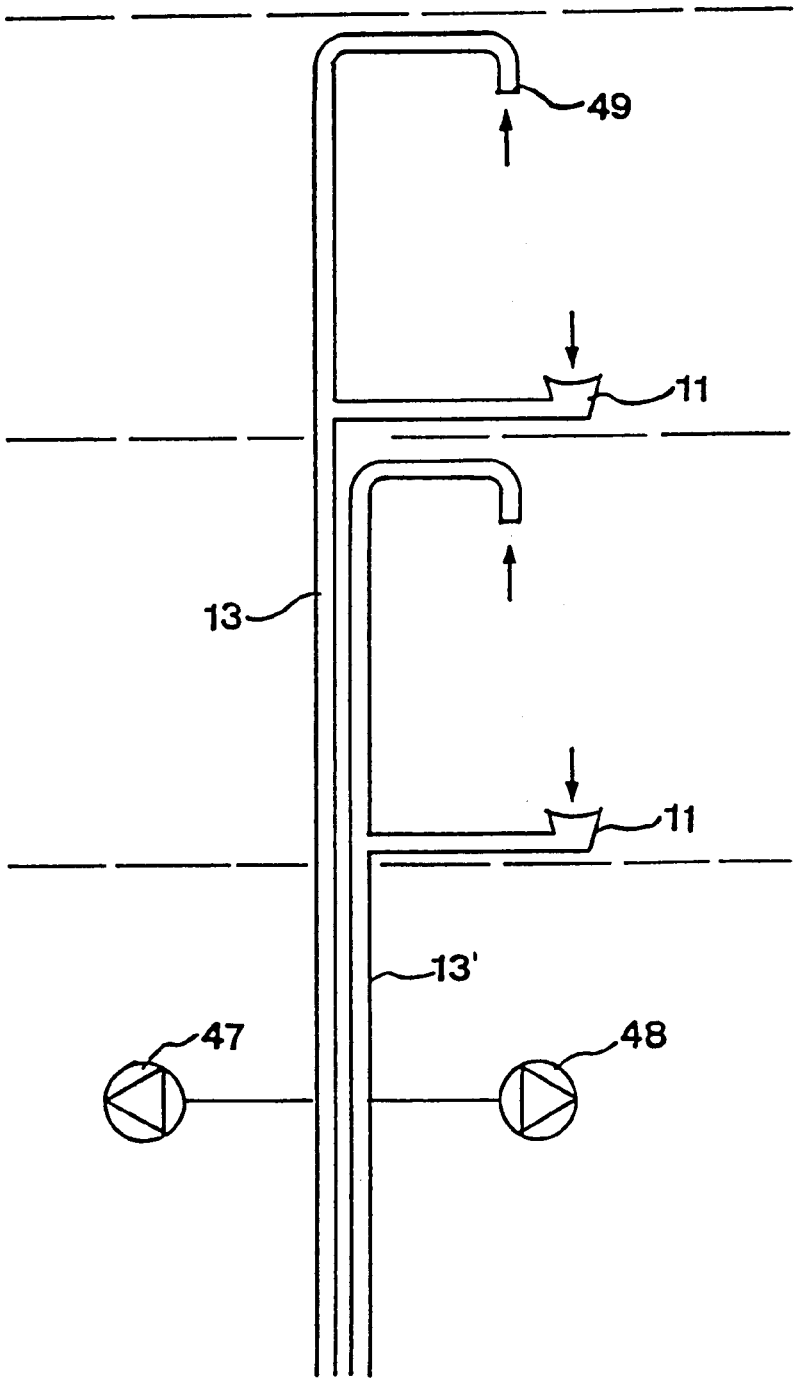
FIG. 3 is a schematical view illustrating one part of a variation of the drain system according to the invention.

It is of course also within the scope of the invention to arrange parallel drain conduits 13 from each of the different water receiving units which are to function as air exhaust devices, which is advantageous in the way that it facilitates the blocking of the conduit to certain designated rooms to separate these from other rooms at for example a fire to provide fire cells. In the embodiment according to FIG. 3 each conduit 13, 13' is also therefore provided with a fan 47, 48 respectively. In FIG. 3 there is also illustrated that a further exhaust air device 49 may be connected to conduits 13, 13' respectively, for example in the roof region of a bathroom, advantageously straight above the shower location, which makes it possible to also take care of water vapour that rises toward the roof in the room in question.

A further advantage with the arrangement according to FIG. 3 is that it will be possible to selectively supply fresh air to possibly confined people in fire situations. A bathroom may in this way by means of such caused "supply air" provide a smoke free and relatively cool environment.

It may further be mentioned that studies have shown that the critical level for relative moisture for most of the toxic micro fungus and similar are 70%, which means that they will disappear at a lower relative moisture. It is easy to sense the relative moisture in the above described system, especially in the case of parallel conduits and when this moisture exceeds the critical level it is easy to increase the flow of air in the precise wet room such that the critical time, i.e. the time when the relative moistureness exceeds 70%, may be kept very short and the moist problems may be reduced considerably in relation to earlier known systems.

What is claimed is:

1. An arrangement in a drain system in a building, wherein said drain system is divided into at least two parts, namely a first part (2) arranged to receive drain water contaminated to a relatively high degree from one or a plurality of first units (3) and a second part (10) separated from said first drain system part (2) and arranged to receive drain water normally contaminated to a lower degree from one or a plurality of second units (11,12) such that drain water emanating from said first (3) and second (11,12) units remains unmixed, characterized in that at least one of said drain system parts (2, 10) comprises at least one drain conduit (13) and at least one unit (11) connected thereto and so constructed that said drain conduit (13) lacks traps preventing a flow of air therethrough, and an apparatus (16) is connected to said drain conduit (13), for generating such a negative pressure in said drain conduit (13) giving rise to an evacuating flow of air from a room in question in said building through said at least one unit (11) and through said drain conduit (13).

2. An arrangement according to claim 1, characterized in that said second drain system part (10) comprises said at least one drain conduit (13) and unit (11) lacking traps and said first units (3) in the first drain system part (2) have traps preventing a flow of air therethrough.

3. An arrangement according to claim 2, wherein the traps are water seals.

4. An arrangement according to claim 1, characterized in that said second drain system part (10) comprises said at least one drain conduit (13) and unit (11) lacking traps and at least one of said units (3) in said first drain system part (2) is so constructed that it lacks traps preventing a flow of air therethrough, as said at least one unit (11) in said second drain system part (10), to enable air evacuation while being affected by negative pressure from a room in the building where said first unit (3) is located.

5. An arrangement according to claim 1, characterized in that, said drain conduit (13) has a trap (17) preventing a flow of air therethrough and arranged such that said apparatus (16) generating the negative pressure is connected to said drain conduit (13) upstream of said trap 17.

6. An arrangement according to claim 4, characterized in that said apparatus (16) generating the negative pressure is arranged to discharge said evacuating flow of air to the surroundings after being heat exchanged (18) with a medium in a heat exchanger (18) downstream of said apparatus (16).

7. An arrangement according to claim 6, additionally comprising means for directing said medium, to supply air to the building.

8. An arrangement according to claim 4, wherein the trap (17) is a water seal.

9. An arrangement according to claim 5, characterized in that said apparatus (16) generating the negative pressure is connected to said drain conduit (13) only upstream of said trap (17).

10. An arrangement according to claim 1, additionally comprising means (30) for conducting drain water received from said second drain system part (10) to said first units (3) of said first drain system part (2) where it is intended to be used as flushing water.

11. An arrangement according to claim 1, characterized in that said second drain system part (10) is divided into at least two separate sections (21, 22) to take care of different kinds of drain water.

12. An arrangement according to claim 11, characterized in that drain water delivering units (11, 12) of different kinds are connected to said two sections.

13. An arrangement according to claim 12, characterized in that one set of said units (11) are constituted by said units lacking traps preventing a flow of air therethrough in a first section (21).

14. An arrangement according to claim 13, characterized in that another set of said units (12) in a second section (22) have traps preventing a flow of air therethrough.

15. An arrangement according to claim 1, characterized in that one or a plurality of the units (11) lacking a flow of air therethrough are floor drains.

16. An arrangement according to claim 1, characterized in that one or a plurality of units having traps preventing a flow of air therethrough are sinks, wash basins or similar.

17. An arrangement according to claim 1, characterized in that one or a plurality of said units lacking traps preventing a flow of air therethrough consist of sinks, washbasins, showers, bathtubs, floor drains or similar.

18. An arrangement according to claim 1, characterized in that at least one drain system part (10) is connected to the surroundings by a conduit portion (23) to achieve natural draught, i.e. a suction effect to the surroundings.

19. An arrangement according to claim 18, characterized in that said apparatus (16) generating a negative pressure in said drain conduit (13) is a fan and a non-return valve (24) is located in said conduit portion (23) preventing an inflow of air through said conduit portion and arranged to open at a breakdown of the fan by means of arised natural draught.

20. An arrangement according to claim 1, characterized in that said second drain system part (10) is connected to a tank (26) for collection of drain water therefrom.

21. An arrangement according the claim 20, characterized in that at least one of the following features (a–c) is arranged to utilize the collected drain water in one or several of the following ways:

(a.) a heat exchanger (43) is arranged to exchange heat from said drain water to another medium; or (b.) Means (45) are arranged for utilizing said collected drain water for fire control; or (c.) Means (46) are arranged for utilizing said collected drain water for watering purposes.

22. An arrangement according the claim 1, wherein each said unit (11) in said second drain system part (10) is provided with an exhaust conduit opening back to a room in which said respective unit (11) is located and with a fan (47, 48) being provided in said respective exhaust conduit, such that a plurality of such exhaust conduits (13, 13') are arranged in parallel from each of the different units (11).

23. An arrangement in a drain system in a building, which drain system comprises at least one drain conduit (13) arranged to receive drain water from at least one unit (11) connected thereto, said unit being so constructed that it lacks traps preventing a flow of air therethrough, and an apparatus (16) being connected to said drain conduit for generating such a negative pressure in said drain conduit that gives rise to an evacuating flow of air from a room in question in the building through said unit (11) and through said drain conduit (13), characterized in that said apparatus generating a negative pressure comprises a fan (16), said drain conduit is connected to the surroundings by a conduit portion (23) to achieve natural draught, i.e. a suction effect towards the surroundings and a non-return valve (24) is located in said conduit portion (23) preventing a flow of air through said conduit portion (23) to said drain conduit (13) and being arranged to open at a breakdown of the fan (16) as a consequence of arised natural draught, said natural draught taking over the function to achieve said evacuating flow of air.

24. An arrangement in a drain system in a building, wherein said drain system is divided in at least two parts, namely a first part (2) arranged to receive drain water contaminated to a relatively high degree from one or a plurality of first units (3), and a second part (10) arranged to receive drain water normally contaminated to a lower degree from one or a plurality of second units (11, 12), characterized in that at least one of said drain system parts (2, 10) comprises at least one drain conduit (13) and at least one unit (11) connected thereto and so constructed that it lacks traps preventing a flow of air therethrough, and that an apparatus (16) is connected to said drain conduit (13), for generating such a negative pressure in said drain conduit giving rise to an evacuating flow of air from the room in question in said building through said at least one unit (11) and through said drain conduit (13) in a way such that the unit functions as an exhaust air device inside the building for ventilation purposes.

* * * * *